US005718280A

United States Patent [19]

Matsuura et al.

[11] Patent Number: 5,718,280

[45] Date of Patent: Feb. 17, 1998

[54] DIE CASTING PROCESS AND DIE CASTING APPARATUS

[75] Inventors: Yoshiki Matsuura, Toyota; Yasuhiro Yamashita, Okazaki, both of Japan

[73] Assignee: Toyota Jidosha Kabushiki Kaisha, Toyota, Japan

[21] Appl. No.: 761,825

[22] Filed: Dec. 6, 1996

[30] Foreign Application Priority Data

Dec. 7, 1995 [JP] Japan ..... 7-319042

[51] Int. Cl.[6] ..... B22D 17/10; B22D 27/02

[52] U.S. Cl. ..... 164/498; 164/113

[58] Field of Search ..... 164/312, 113, 164/147.1, 498

[56] References Cited

FOREIGN PATENT DOCUMENTS 4-143058 5/1992 Japan .

*Primary Examiner*—Kuang Y. Lin

*Attorney, Agent, or Firm*—Cushman Darby & Cushman IP Group of Pillsbury Madison & Sutro LLP

[57] ABSTRACT

A die casting process, and a die casting apparatus make it possible to produce high-quality cast products, which little involve gas defects, with simplified constructions, such as an electromagnetic induction coil disposed around a plunger sleeve, and a contractible container disposed movably in a plunger sleeve. With these simplified constructions, a molten metal is localized on a side of a retracted plunger chip disposed in the plunger sleeve. Accordingly, when the retracted plunger chip is advanced, only gases, contained in the plunger sleeve, can be transferred to a cavity of a mold at first, and thereafter the localized molten metal can be injected into the cavity. Thus, it is possible to effectively inhibit the molten metal from involving the gases.

7 Claims, 5 Drawing Sheets

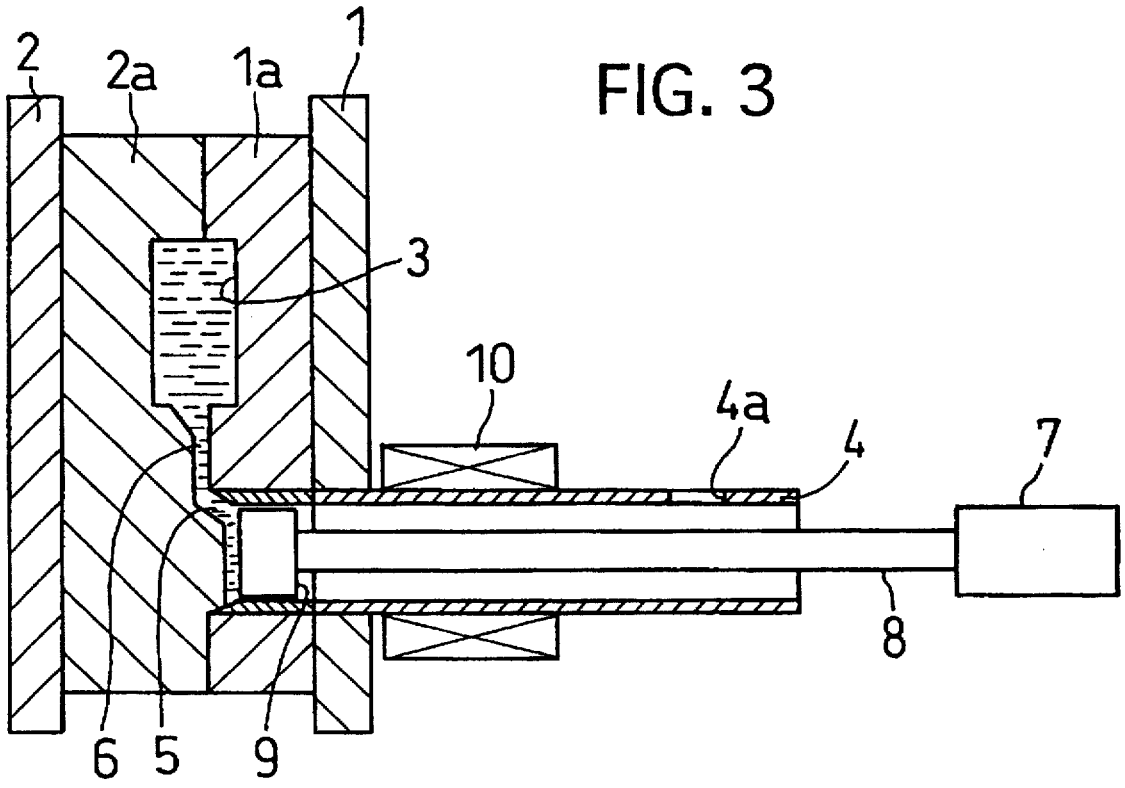
FIG. 3
FIG. 4
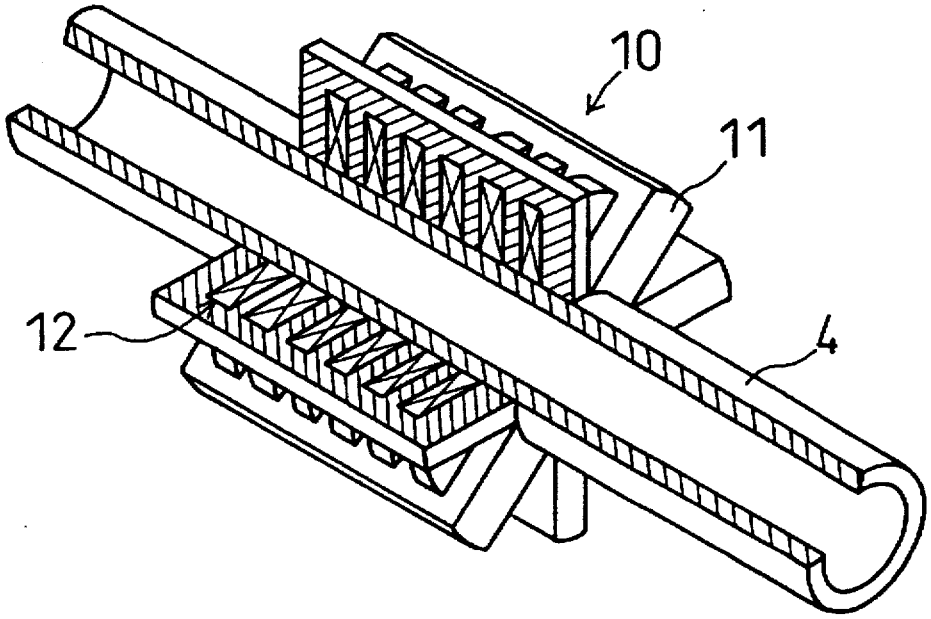

DIE CASTING PROCESS AND DIE CASTING APPARATUS

BACKGROUND OF THE INVENTION

1. Field of the Invention

The present invention relates to a die casting process for injecting a molten metal into a cavity of a mold, and to an apparatus therefor.

2. Description of the Related Art

In a die casting process for injecting a molten metal into a cavity of a mold at a fast rate, a molten metal is supplied into a plunger sleeve via a sprue, and a plunger chip is advanced to inject the supplied molten metal into a cavity of a clamped mold. The plunger chip is disposed movably in the plunger sleeve. In order to inhibit the molten metal from spilling at the sprue, a filling ratio of the plunger sleeve is usually designed to be from 30 to 70%. Accordingly, there exists air above the molten metal in the plunger sleeve. As a result, the molten metal shakes to involve the air therein. Thus, in the conventional die casting, the gas defects, such as gross porosities, or the like, are likely to occur. The term, "filling ratio", herein means the quotient (i.e., a volume $V_0$ of the molten metal divided by a volume V of the plunger sleeve) multiplied by 100.

Japanese Unexamined Patent Publication (KOKAI) No. 4-143,058 discloses a die casting apparatus which can inhibit the gas defects from occurring. The die casting apparatus is provided with two plunger sleeves and two plunger chips in order to increase the filling ratio in one of the plunger sleeves, thereby inhibiting the gas defects.

As illustrated in FIGS. 8 and 9, in the die casting apparatus, a cavity 83 is formed between a stationary mold 81 and a movable mold 82 which are clamped together. A first plunger sleeve 84 has a sprue 84*a*, and is fired into a sleeve-receiving hole of the stationary mold 81. The inside of the first plunger sleeve 84 is communicated with the cavity 83 by way of a runner 85 and a gate 86. The runner 85 is formed in the stationary mold 81. The gate 86 is formed in the movable mold 82, and is disposed above the runner 85. A second plunger sleeve 88 is fired movably into the first plunger sleeve 84, and is connected to a hydraulic cylinder 87. Further, a first plunger chip 89 is fired movably into the second plunger sleeve 88. Furthermore, a hydraulic cylinder 90 is fired into the second plunger sleeve 88, and actuates the first plunger chip 89 to advance and retract. Moreover, the second plunger sleeve 88 is provided with a molten-metal inlet port 88*a* and a molten-metal outlet port 88*b*. The molten-metal inlet port 88*a* communicates with the spruce 84*a* of the first plunger sleeve 84 when the second plunger sleeve 88 is positioned at a retracted end. The molten-metal outlet port 88*b* communicates with the runner 85 when the second plunger sleeve 88 is positioned at an advanced end. In addition, a second plunger chip 91 is fixed at the leading end of the second plunger sleeve 88.

As illustrated in FIG. 8, in the die casting apparatus, the first plunger chip 89 and the second plunger chip 91 are retracted to supply a molten metal, and a molten metal is supplied into the second plunger sleeve 88 via the sprue 84*a*. Consequently, the sleeve-filling ratio can be 100% approximately in the second plunger sleeve 88. Then, the first plunger chip 89 and the second plunger chip 91 are advanced by actuating the hydraulic cylinder 87, and accordingly the molten metal can be transferred under the runner 85 while keeping the sleeve-filling ratio at about 100%. The situation is illustrated in FIG. 9. Thereafter, only the first plunger chip 89 is advanced by actuating the hydraulic cylinder 90, and thereby the molten metal, held in the second plunger sleeve 88, is injected into the cavity 83. As a result, when injecting the molten metal, the die casting apparatus can effectively inhibit the molten metal from involving the air.

However, the die casting apparatus disclosed in the publication has a complicated construction, because it requires two plunger sleeves and two plunger chips, and because it further requires two hydraulic cylinders to actuate one of the plunger sleeves and another one of the plunger chips, respectively. Further, when one intends to apply the die casting apparatus to existing die casting machines, or the like, the manufacturing facilities should be modified considerably. Furthermore, the second plunger sleeve 88 might not be operated properly, because the second plunger sleeve 88 slides in the first plunger sleeve 84. Specifically, the second plunger sleeve 88 might be subjected to enlarged sliding resistance which results from the thermal deformations of the first and second plunger sleeves 84 and 88, or might be seized by the molten metal which impregnates into the sliding clearance between the first and second plunger sleeves 84 and 88.

SUMMARY OF THE INVENTION

The present invention has been developed in view of the aforementioned circumstances. It is therefore an object of the present invention to provide a die casting process which can effectively inhibit a molten metal from involving a gas contained in a plunger sleeve when a molten metal is injected. It is a further object of the present invention to provide a die casting apparatus which can carry out the novel die casting process, and which has a simplified construction applicable to existing die casting machine with ease.

A die casting process according to a first aspect of the present invention can carry out the object, and comprises the steps of:

retracting a plunger chip disposed movably in a plunger sleeve connected to a cavity of a mold;

supplying a molten metal into the plunger sleeve with the retracted plunger chip disposed therein;

localizing the supplied molten metal on a side of the retracted plunger chip by means of an electromagnetic force induced by an electromagnetic induction coil; and advancing the retracted plunger chip to inject the localized molten metal into the cavity.

A die casting process according to a second aspect of the present invention can carry out the further object, and comprises:

a plunger sleeve connected to a cavity of a mold, and receiving a supply of a molten metal;

a plunger chip disposed movably in the plunger sleeve, and injecting the supplied molten metal into the cavity; and an electromagnetic induction coil disposed around the plunger sleeve.

In accordance with the die casting process according to the first aspect, and in accordance with the die casting apparatus according to the second aspect, the molten metal is supplied into the plunger sleeve, and is then localized on a side of the retracted plunger chip by means of the electromagnetic force induced by the electromagnetic induction coil. Under the circumstances, the retracted plunger chip is advanced. Accordingly, only gases, contained in the plunger sleeve, can be sent into the cavity of the mold at first, and thereafter the localized molten metal can be injected into the cavity. As a result, when the molten metal is injected, it is possible to effectively inhibit the molten metal from involving the gases.

Another die casting process according to a third aspect of the present invention can carry out the object, and comprises the steps of:

retracting a plunger chip disposed movably in a plunger sleeve connected to a cavity of a mold;

supplying a molten metal into a contractible container disposed movably from an advanced position to a retracted position in the plunger sleeve, the contractible container positioned at the retracted position; and advancing the contractible container filled with the supplied molten metal by advancing the retracted plunger chip, and contracting the contractible connector to inject the filled molten metal into the cavity.

Another die casting process according to a fourth aspect of the present invention can carry out the further object, and comprises:

a plunger sleeve connected to a cavity of a mold, and receiving a supply of a molten metal;

a plunger chip disposed movably in the plunger sleeve, and injecting the supplied molten metal into the cavity; and a contractible container disposed movably in the plunger sleeve, and holding the supplied molten metal therein.

In accordance with the another die casting process according to the third aspect, and in accordance with the another die casting apparatus according to the fourth aspect, the molten metal is supplied into and filled in the contractible container positioned at the retracted position. Along with the plunger chip, the contractible container filled with the supplied molten metal is advanced, and is contracted to inject the filled molten metal into the cavity of the mold. Accordingly, only gases, contained in the plunger sleeve, can be sent into the cavity of the mold at first, and thereafter the filled molten metal can be injected into the cavity. As a result, when the molten metal is injected, it is possible to effectively inhibit the molten metal from involving the gases. Moreover, the molten metal can be kept from directly contacting with the plunger sleeve, because the contractible container interposes between the molten metal and the plunger sleeve. Thus, it is possible to inhibit the molten metal from damaging the plunger sleeve.

As having described so far, the die casting processes and the die casting apparatuses according to the present invention employ the simplified constructions, for instance, the electromagnetic induction coil disposed around the plunger sleeve, and the contractible container disposed movably in the plunger cylinder. The simplified constructions enable the molten metal, supplied in the plunger sleeve, to localize on the side of the plunger chip, and also enable the localized molten metal to spout into the cavity. As a result, the simplified constructions can inhibit the molten metal from involving the gases, such as air, or the like, and accordingly can produce high-quality cast products which little involve the gas defects.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 3 is a cross-sectional view of the present die casting apparatus according to the First Preferred Embodiment, and illustrates a state after the localized molten metal is injected;

FIG. 4 is a perspective view of an electromagnetic induction coil assembly (designated at 10) in the present die casting apparatus according to the First Preferred Embodiment, and illustrates partly in cross-section how the electromagnetic induction coil assembly is constructed;

DETAILED DESCRIPTION OF THE PREFERRED EMBODIMENTS

Figure 1:
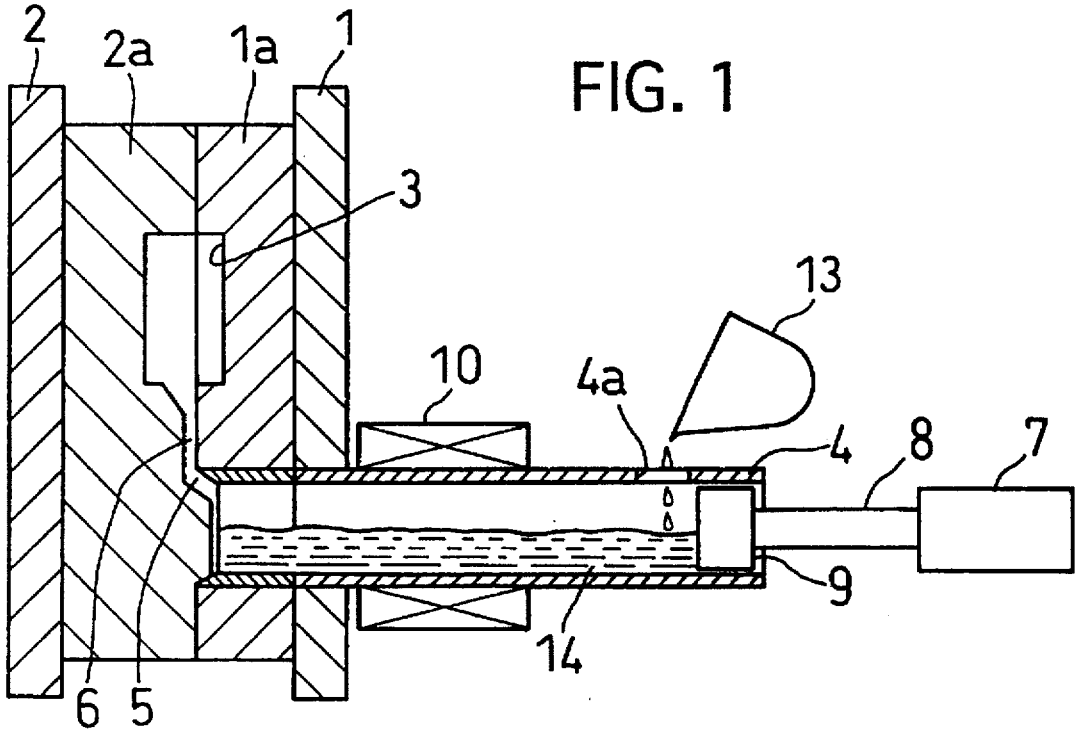
FIG. 1 is a cross-sectional view of a die casting apparatus according to a First Preferred Embodiment of the present invention, and illustrates how a molten metal is supplied.

Having generally described the present invention, a further understanding can be obtained by reference to the specific preferred embodiments which are provided herein for the purpose of illustration only and not intended to limit the scope of the appended claims.

Die casting processes and die casting apparatuses according to preferred embodiments of the present invention will be hereinafter described in detail with reference to the aforementioned drawings.

First Preferred Embodiment

FIGS. 1 through 4 illustrate a First Preferred Embodiment of the present invention. The First Preferred Embodiment is an application of the die casting process according to the first aspect of the present invention and the die casting apparatus according to the second aspect of the present invention to aluminum-alloy die casting.

A die casting apparatus according to the present invention will be first described in terms of the construction. The die casting apparatus includes a stationary plate 1, a stationary mold 1*a*, a movable plate 2, and a movable mold 2*a*. The stationary mold 1*a* is installed to the stationary plate 1. The movable mold 2*a* is installed to the movable plate 2, and is advanced to and retracted from the stationary mold 1*a* to close and open an entire mold. When the entire mold is closed, there is formed a cavity 3 between the stationary mold 1*a* and the movable mold 2*a*. The stationary plate 1 and the stationary mold 1*a* are provided with a plunger-sleeve-receiving hole into which a plunger sleeve 4 is fitted. The plunger sleeve 4 is made from either ceramics or metal, and is provided with a sprue 4*a*. The inner space of the plunger sleeve 4 is communicated with the cavity 3 by way of a runner 5 and a gate 6. The runner 5 is formed in the stationary mold 1*a*. The gate 6 is formed in the movable mold 2*a*, and is disposed above the runner 5. A plunger chip 9 is fitted movably into the plunger sleeve 4. The plunger chip 9 is made from either ceramics or metal, and is connected to a rod 8 of an injection cylinder 7.

Figure 2:
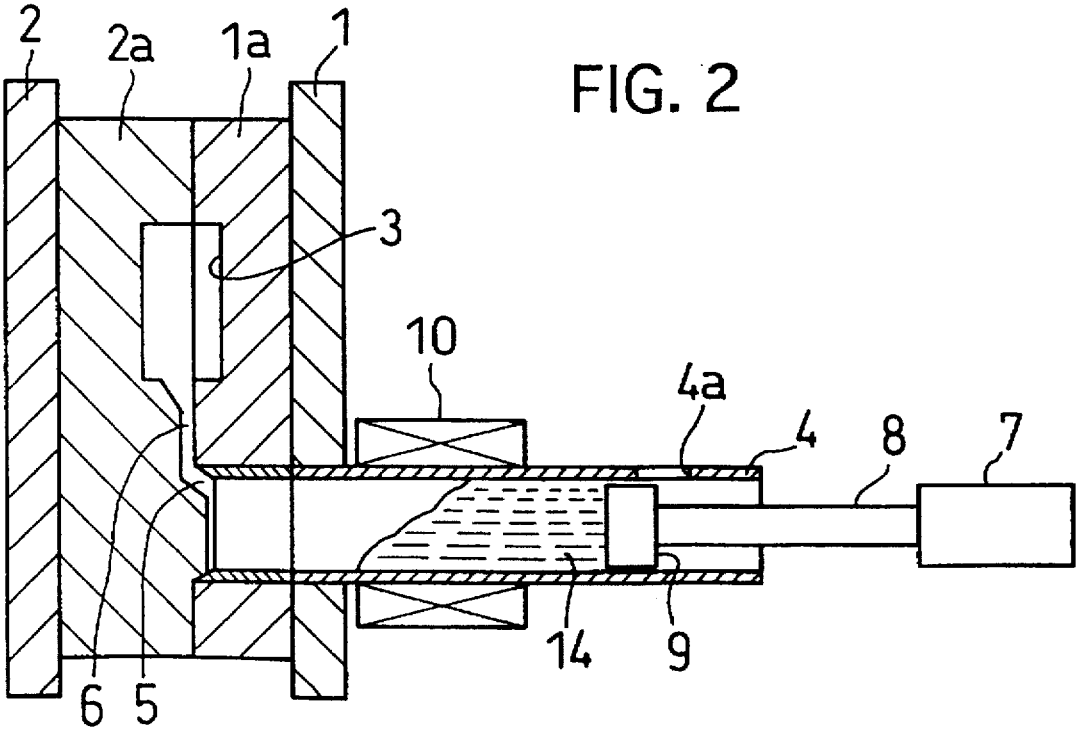
FIG. 2 is a cross-sectional view of the present die casting apparatus according to the First Preferred Embodiment, and illustrates how the molten metal, supplied in a plunger sleeve, is localized on a side of a plunger chip.

Moreover, as illustrated in FIGS. 1 through 3, the plunger sleeve 4 is projected from the stationary plate 1. On an outer peripheral surface of the projecting plunger sleeve 4, an electromagnetic induction coil assembly 10 is disposed adjacent to the stationary plate 1. As illustrated in FIG. 4, the electromagnetic induction coil assembly 10 includes a plurality of rectangle-shaped metallic radiation plates 11, and a plurality of induction coils 12. The metallic radiation plates 11 stick out from the outer peripheral surface of the plunger sleeve 4 radially, and their major-width sides run parallel to the axial direction of the plunger sleeve 4. The induction coils 12 are wound around the outer peripheral surface of the plunger sleeve 4 through the metallic radiation plates 11 and the spaces interposing the metallic radiation plates 11, and receive a supply of a predetermined electric current from an electric-current source (not shown). As a result of the electric-current supply to the induction coils 12, an electromagnetic force is generated in accordance with the Fleming's left-hand rule. Hence, the magnitude and direction of the electric current supplied to the induction coils 12, and the number of turns in the induction coils 12 can be appropriately determined so that the generated electromagnetic force can satisfactorily localize a molten metal, supplied into the plunger sleeve 4, on the side of plunger chip 9. For example, the frequency of the supplied electric current can be about 10 Hz, and the number of turns in the induction coils 12 can be 20 turns.

The thus constructed die casting apparatus is operated in the following manner: as illustrated in FIG. 1, the plunger chip 9 is retraced behind the sprue 4*a* by actuating the injection cylinder 7. With the plunger chip 9 thus retracted, a molten metal 14 is supplied into the plunger sleeve 4 from a ladle 13 via the sprue 4*a*. The supplying amount of the molten metal 14 is not limited in particular. Note that, however, the supplying mount can be designed to be an ordinary sleeve-filling ratio (e.g., from 30 to 70%). Then, the plunger chip 9 is advanced slightly by actuating the injection cylinder 7 to close the sprue 4*a*. With the sprue 4*a* thus closed, a predetermined electric current is input into the electromagnetic induction coils 12 of the electromagnetic induction coil assembly 10 to let the electromagnetic induction coils 12 generate an electromagnetic force. Accordingly, as illustrated in FIG. 2, the molten metal 14, supplied into the plunger sleeve 4, is moved to and localized on the side of the plunger chip 9 by the thus generated electromagnetic force. Consequently, only gases, such as air, or the like, are present in the plunger sleeve 4 on the side of the cavity 3. On the other hand, in the plunger sleeve 4 on the side of the plunger chip 9, a cross-sectional-area occupying ratio of the molten metal 14 can be virtually 100%. Thereafter, as illustrated in FIG. 3, the plunger chip 9 is further advanced by actuating the injection cylinder 7. Note that the electromagnetic force can be kept induced by the electromagnetic induction coil assembly 10 when the plunger chip 9 is further advanced. Thus, only the gases, such as air, or the like, can be first transferred into the cavity 3 by way of the runner 5 and the gate 6, and subsequently the molten metal 14 can be injected into the cavity 3 while keeping the cross-sectional-area occupying ratio substantially at 100% approximately. As a result, when injecting the molten metal 14, it is possible to effectively inhibit the molten metal 14 from involving the gases which have existed in the plunger sleeve 4. All in all, it is possible to produce high-quality cast products which little involve the gas defects. Note that the term, "cross-sectional-area occupying ratio", herein means the quotient (i.e., a cross-sectional area of the molten metal 14 divided by a cross-sectional area of the plunger sleeve 4) multiplied by 100.

The die casting apparatus according to the First Preferred Embodiment can be applied to existing die casting machines with ease, because it employs the simplified construction: namely; the electromagnetic induction coil assembly 10 disposed on the outer peripheral surface of the plunger sleeve 4. Moreover, the conventional die casting apparatus is provided with two plunger sleeves, etc., and accordingly might be operated improperly by the molten-metal seizure. Contrary to the conventional die casting apparatus, the die casting apparatus according to the First Preferred Embodiment will not suffer from the drawback, because it employs the single independent plunger sleeve 4.

Second Preferred Embodiment

Figure 5:
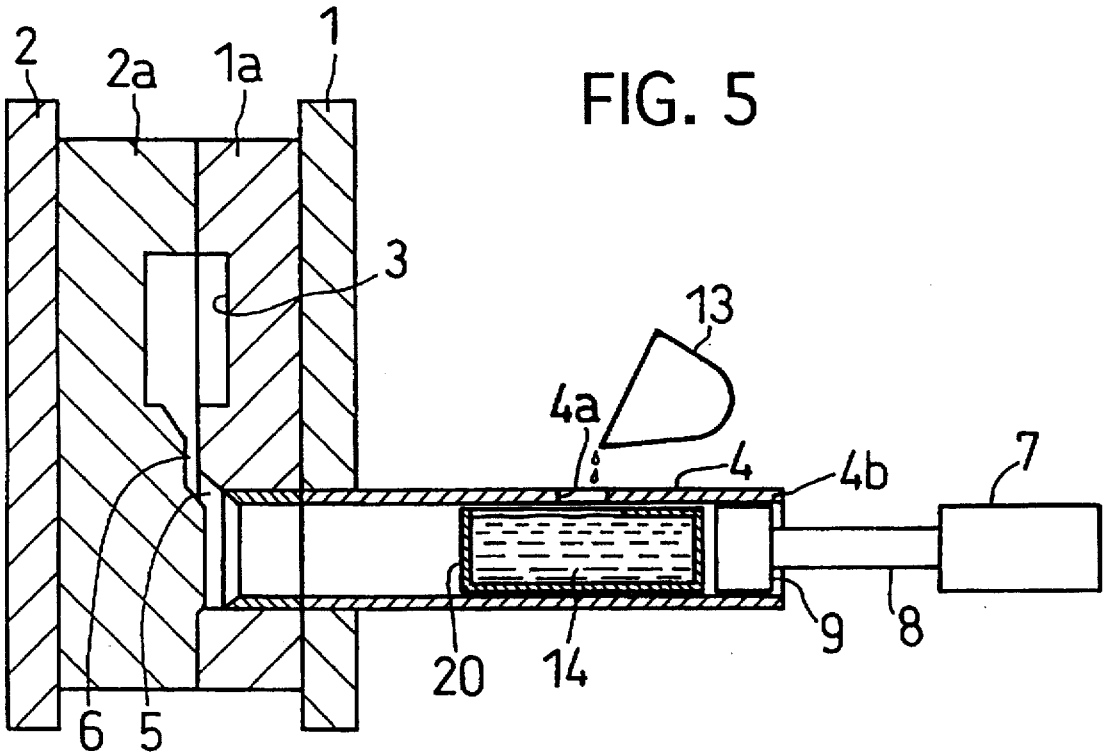
FIG. 5 is a cross-sectional view of a die casting apparatus according to a Second Preferred Embodiment of the present invention, and illustrates how a molten metal is supplied.
Figure 6:
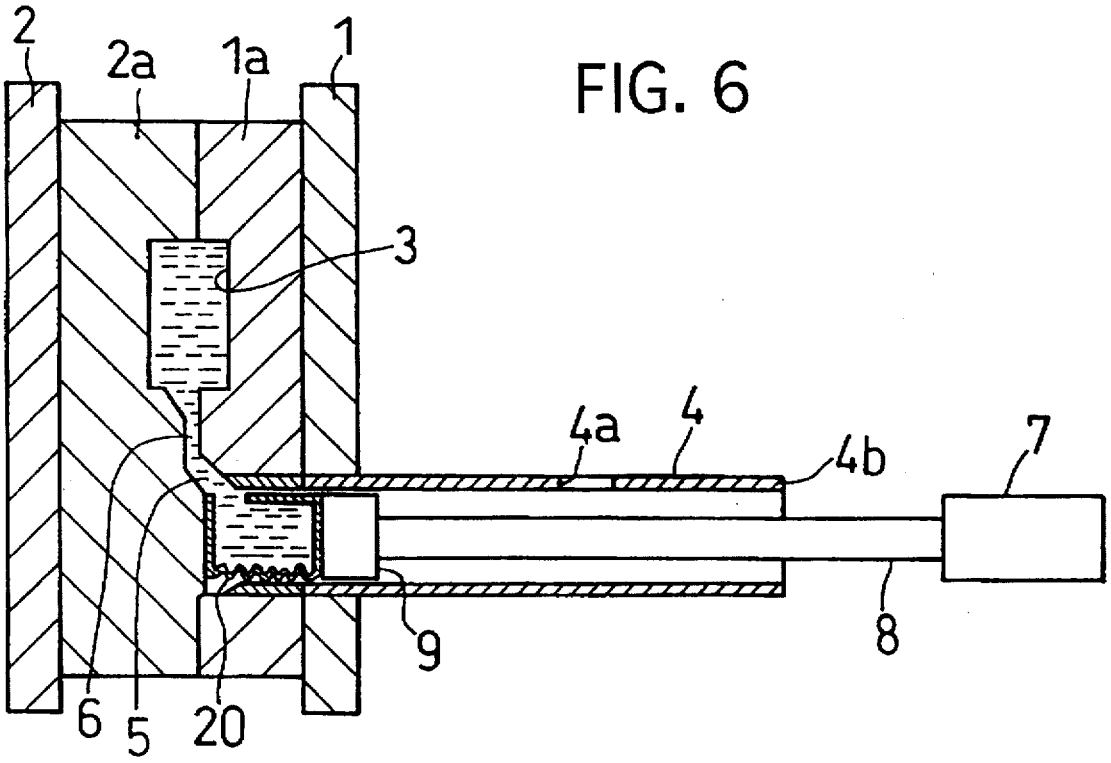
FIG. 6 is a cross-sectional view of the present die casting apparatus according to the Second Preferred Embodiment, and illustrates a state after the supplied molten metal is injected.
Figure 7:
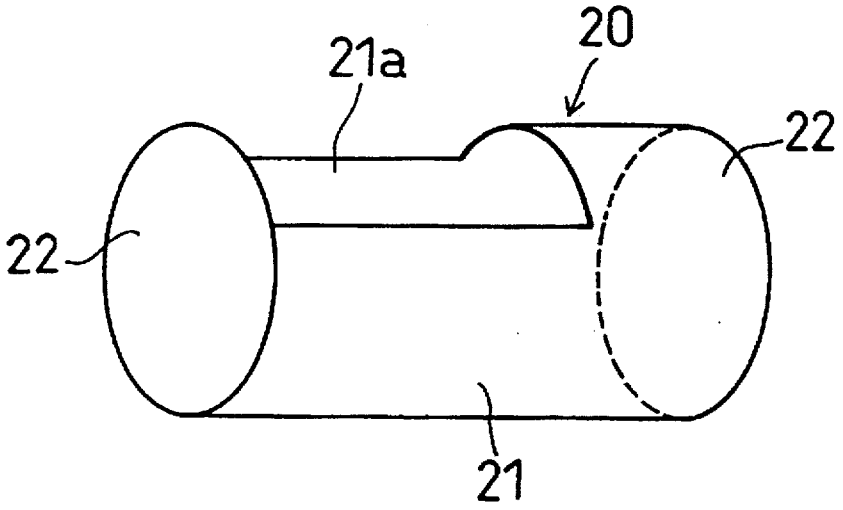
FIG. 7 is a perspective view of a molten metal pack (or a contractible container) in the present die casting apparatus according to the Second Preferred Embodiment, and illustrates a configuration of the molten metal pack schematically.
Figure 8:
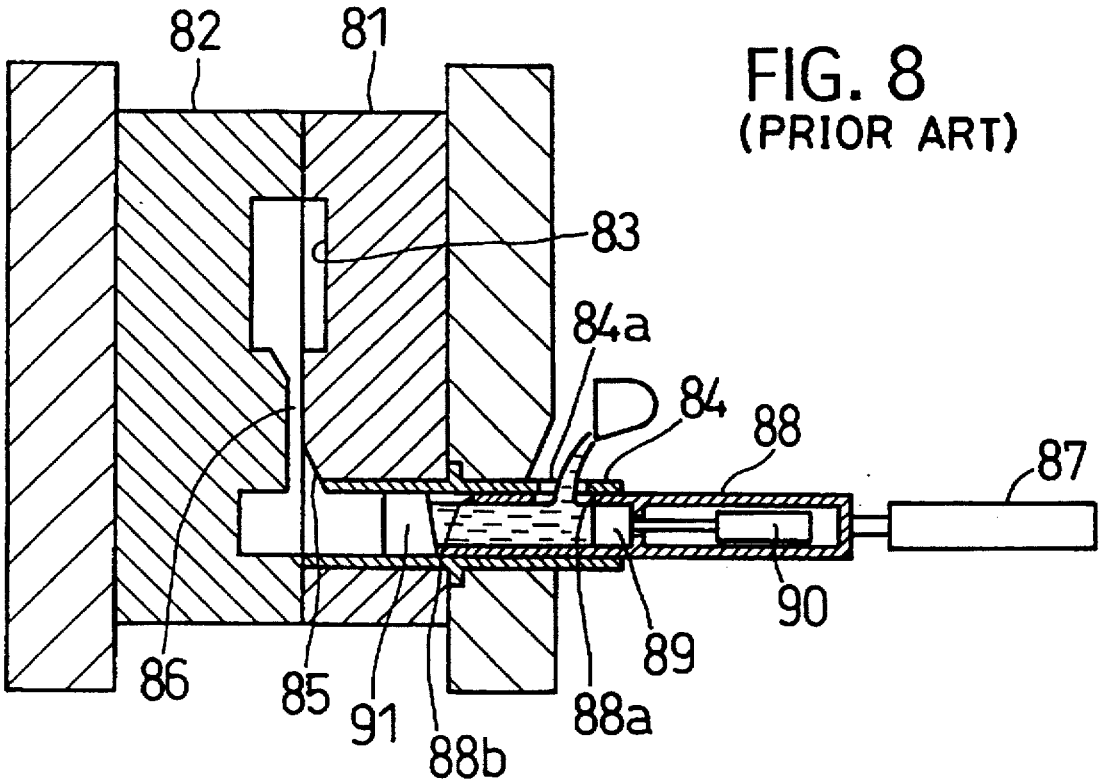
FIG. 8 (PRIOR ART)
FIG. 8 is a cross-sectional view of a conventional die casting apparatus, and illustrates how a molten metal is supplied.
Figure 9:
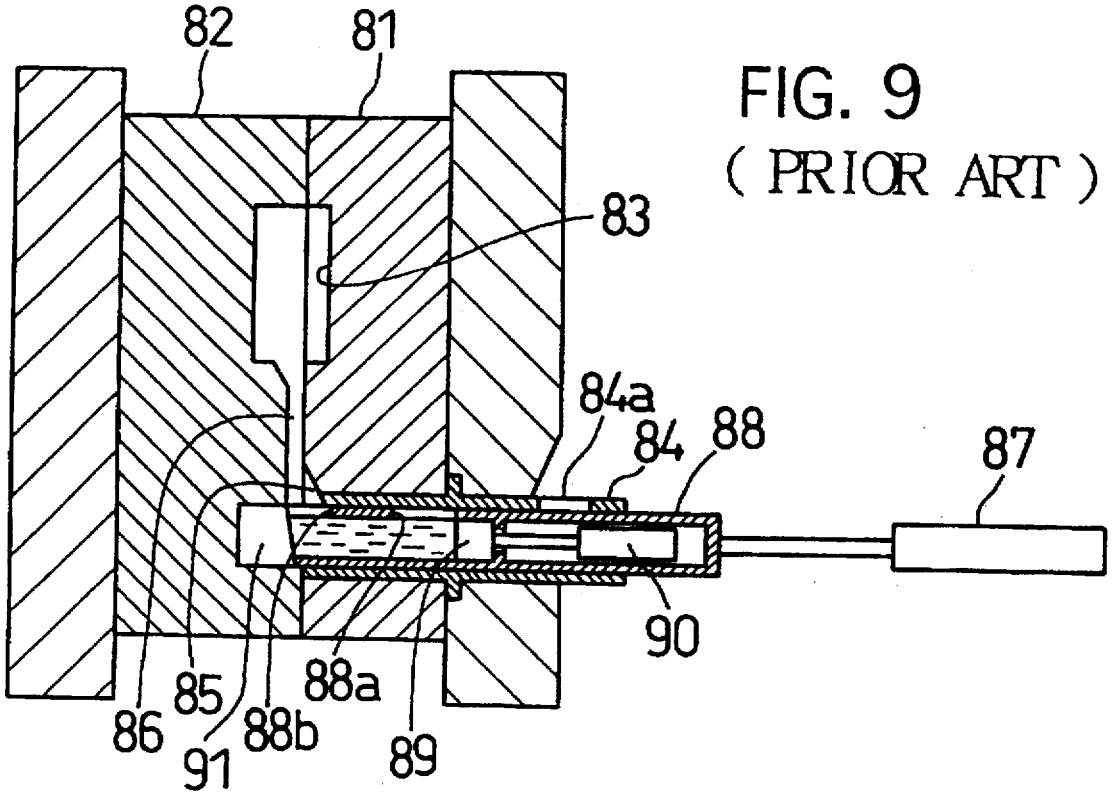
FIG. 9 ( PRIOR ART )
FIG. 9 is a cross-sectional view of the conventional die casting apparatus, and illustrates a state immediately before the supplied molten metal is injected into a cavity.

FIGS. 5 through 7 illustrate a Second Preferred Embodiment of the present invention. Except that a molten-metal pack 20 is employed, a die casting apparatus according to the Second Preferred Embodiment has basically the same construction as that of the die casting apparatus according to the First Preferred Embodiment.

Specifically, in the die casting apparatus according to the Second Preferred Embodiment, a molten-metal pack 20 is disposed movably in a plunger sleeve 4. Note that the molten-metal pack 20 works as the contractible container according to the third and fourth aspects of the present invention. The molten-metal pack 20 is made from pure aluminum. As illustrated in FIG. 7, the molten-metal pack 20 includes a cylinder-shaped member 21, and a pair of disks 22, 22. The cylinder-shaped member 21 has an opening 21*a* facing upwardly. The upwardly-facing opening 21*a* is prepared by removing the upper leading-end portion of a cylinder-shaped workpiece and by leaving the trailing-end portion thereof by a minute margin. The disks 22, 22 enclose the opposite ends of the cylinder-shaped member 21. Note that the outside diameter of the cylinder-shaped member 21 and the disks 22, 22 is designed to be substantially identical with the inside diameter of the plunger sleeve 4.

The thickness of the cylinder-shaped member 21 and the disks 22, 22 is not limited in particular. However, the thickness can preferably fall in a range of from 0.1 to 0.5 mm approximately. In the Second Preferred Embodiment, both of the cylinder-shaped member 21 and the disks 22, 22 are designed to have a thickness of 0.3 min. In addition to the pure aluminum, the molten-metal pack 20 can be made from a material which is contractible, and which has a melting point higher than a temperature of the employed molten metal 14. Moreover, the configuration and size of the molten-metal pack 20 are not limited in particular, either. However, in order to enlarge the cross-sectional-area occupying ratio of the molten metal 14 as much as possible, the molten-metal pack 20 can preferably be designed to have the same configuration and the same size as those of the inner peripheral surface of the plunger sleeve 4.

In the Second Preferred Embodiment, the molten-metal pack 20 is taken out together with an as-cast product. Therefore, it is necessary to set the molten-metal pack 20 in the plunger sleeve 4 for every casting operation. The setting of the molten-metal pack 20 can be carried out in the following manner: the plunger chip 9 is removed from the plunger sleeve 4. The molten-metal pack 20 is fired into the plunger sleeve 4 by way of the opposite opening 4*b* which is disposed furthest away from the runner 5, and is placed at a predetermined position in the plunger sleeve 4. Thereafter, the plunger chip 9 is again fitted into the plunger sleeve 4 by way of the opposite opening **4*b***.

The thus constructed die casting apparatus is operated in the following manner: as illustrated in FIG. 5, the molten-metal pack 20 is positioned so that one of the opposite ends (e.g., the opposite end furthest away from the runner 5) of the upwardly-facing opening **21*a* is placed below the sprue 4*a* of the plunger sleeve 4, and the plunger chip 9 is positioned on the rear side of the molten-metal pack 20. Then, the molten metal 14 is supplied into the plunger sleeve 4 from the ladle 13 via the sprue 4*a*. Note that the molten metal 14 is supplied into the molten-metal pack 20 so that the cross-sectional-area occupying ratio of the molten metal 14 is virtually 100% in the molten-metal pack 20. Thereafter, as illustrated in FIG. 6, the molten-metal pack 20 is advanced along with the plunger chip 9 by actuating the injection cylinder 7, and the molten-metal pack 20 is held and pressurized between the end surface of the movable mold 2*a* and the plunger chip 9. As a result, the molten-metal pack 20 is compressed to deform, and accordingly the molten metal 14 filled in the molten-metal pack 20 can be injected into the cavity 3**.

In a manner similar to the First Preferred Embodiment, in the Second Preferred Embodiment as well, only the gases, such as air, or the like, can be first transferred into the cavity 3 by way of the runner 5 and the gate 6, and subsequently the molten metal 14 can be injected into the cavity 3 while keeping the cross-sectional-area occupying ratio substantially at 100% approximately. Note that the gases have been present in the plunger sleeve 4. As a result, when injecting the molten metal 14, it is possible to effectively inhibit the molten metal 14 from involving the gases which have existed in the plunger sleeve 4. All in all, it is possible to produce high-quality cast products which little involve the gas defects.

The die casting apparatus according to the Second Preferred Embodiment can inhibit cast products from involving the gas defects with extreme readiness, and at a remarkably low cost, because it simply employs the molten-metal pack 20, and because it does not require electric facilities in addition to the molten-metal pack 20.

Moreover, the molten-metal seizure is less likely to occur between the molten-metal pack 20 and the plunger sleeve 4, because the molten-metal pack 20 is reset for every casting operation.

In the First and Second Preferred Embodiments, a sprue bushing can substitute for the portion of the plunger sleeve 4 adjacent to the runner 5.

In addition, the First and Second Preferred Embodiments describe how to apply the present invention to aluminum-alloy casting. The present invention can be applied, of course, to casting for the other metals, such as cast iron, etc.

Having now fully described the present invention, it will be apparent to one of ordinary skill in the art that many changes and modifications can be made thereto without departing from the spirit or scope of the present invention as set forth herein including the appended claims.

What is claimed is:

1. A die casting process, comprising the steps of:

retracting a plunger chip disposed movably in a plunger sleeve connected to a cavity of a mold;

supplying a molten metal into the plunger sleeve with the retracted plunger chip disposed therein;

localizing the supplied molten metal on a side of the retracted plunger chip by means of an electromagnetic force induced by an electromagnetic induction coil; and advancing the retracted plunger chip to inject the localized molten metal into the cavity.

2. The die casting process according to claim 1, wherein, in said molten-metal supplying step, the molten metal occupies in the plunger sleeve with a cross-sectional-area occupying ratio of from 30 to 70%.

3. The die casting process according to claim 1, wherein, in said supplied-molten-metal localizing step, the molten metal occupies on the side of the retracted plunger chip in the plunger sleeve with a cross-sectional-area occupying ratio of 100% virtually.

4. The die casting process according to claim 1, wherein, in said supplied-molten-metal localizing step, the electromagnetic force is induced by the electromagnetic induction coil which is disposed on a side of the mold.

5. The die casting process according to claim 1, wherein, in said retracted-plunger-chip advancing step, the molten metal occupies on the side of the retracted plunger chip in the plunger sleeve with a cross-sectional-area occupying ratio of 100% virtually.

6. The die casting process according to claim 1, wherein, in said retracted-plunger chip advancing step, gases contained in the plunger sleeve are transferred into the cavity at first.

7. The die casting process according to claim 1, wherein, in said retracted-plunger-chip advancing step, the electromagnetic force is kept induced by the electromagnetic induction coil.

* * * * *

UNITED STATES PATENT AND TRADEMARK OFFICE

CERTIFICATE OF CORRECTION

PATENT NO. : 5,718,280

DATED : February 17, 1998

INVENTOR(S) : MATSUURA

It is certified that error appears in the above-identified patent and that said Letters Patent is hereby corrected as shown below:

On the title page, item [75] Inventor: should read
-- Yoshiki Matsuura, Toyota, Japan --

Signed and Sealed this

Seventeenth Day of August, 1999

*Attest:*

Q. TODD DICKINSON

*Attesting Officer*

*Acting Commissioner of Patents and Trademarks*